US005234277A

United States Patent [19]

Le

[11] Patent Number: 5,234,277

[45] Date of Patent: Aug. 10, 1993

[54] BUSINESS CARD FILING ORGANIZATION

[76] Inventor: Andrew D. T. Le, 3853 Dean Place Way, San Jose, Calif. 95121

[21] Appl. No.: 877,796

[22] Filed: May 4, 1992

[51] Int. Cl.[5] ..... B42F 13/00; B42F 19/00

[52] U.S. Cl. ..... 402/79; 40/391; 40/393; 116/211; 402/80 R

[58] Field of Search ..... 40/379, 391, 393, 405, 40/537, 663; 116/211, 307, 234; 402/79, 80 R

[56] References Cited

U.S. PATENT DOCUMENTS

| | | | |
|---|---|---|---|
| 4,849,056 | 7/1989 | Ristuccia, Sr. | 402/79 |
| 4,905,392 | 3/1990 | Klein | 402/79 X |
| 4,930,928 | 6/1990 | Ristuccia, Sr. | 402/79 |
| 4,963,049 | 10/1990 | Pearson | 402/79 |

FOREIGN PATENT DOCUMENTS

| | | | |
|---|---|---|---|
| 929216 | 12/1947 | France | 40/405 |
| 1054210 | 1/1967 | United Kingdom | 40/405 |

OTHER PUBLICATIONS

Miller's Office Products Catalog circa 1989, p. 268.

*Primary Examiner*—Paul A. Bell
*Attorney, Agent, or Firm*—Leon Gilden

[57] ABSTRACT

A rotary filing system is arranged to include a plurality of card holders, with each card holder including at least a forward transparent window arranged to coextensively extend over a pocket to receive a business card. A modification of the invention includes readily mounted tab and marking structure to indicate various categorizing of the business cards mounted within the structure.

3 Claims, 4 Drawing Sheets

BUSINESS CARD FILING ORGANIZATION

BACKGROUND OF THE INVENTION

1. Field of the Invention

The field of invention relates to business card filing structure, and more particularly pertains to a new and improved business card filing organization wherein the same is arranged to provide for pocket structure relative to a filing member to house business cards therewithin.

2. Description of the Prior Art

The wide spread contemporary use of business cards for information is present in the prior art, wherein filing systems to support business card members have been heretofore presented in the U.S. Pat. No. 4,963,049 to Pearson having an elongate strip of material accommodating a business card thereon.

U.S. Pat. No. 4,905,392 to Klein sets forth an adhesive backed business card for mounting to a file card.

U.S. Pat. No. 4,930,928 to Ristuccia, Sr. sets forth a business card plate having slots to receive a business card thereon, and similarly U.S. Pat. No. 4,849,056 to Ristuccia, Sr. sets forth a similar type organization.

Accordingly, it may be appreciated that there continues to be a need for a new and improved business card filing organization as set forth by the instant invention which addresses both the problems of ease of use as well as effectiveness in construction in accommodating in a releasable manner various business card components and in this respect, the present invention substantially fulfills this need.

SUMMARY OF THE INVENTION

In view of the foregoing disadvantages inherent in the known types of business card filing structure now present in the prior art, the present invention provides a business card filing organization wherein the same is arranged to selectively mount business cards. As such, the general purpose of the present invention, which will be described subsequently in greater detail, is to provide a new and improved business card filing organization which has all the advantages of the prior art business card filing structure and none of the disadvantages.

To attain this, the present invention provides a rotary filing system arranged to include a plurality of card holders, with each card holder including at least a forward transparent window arranged to coextensively extend over a pocket to receive a business card. A modification of the invention includes readily mounted tab and marking structure to indicate various categorizing of the business cards mounted within the structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the Public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved business card filing organization which has all the advantages of the prior art business card filing structure and none of the disadvantages.

It is another object of the present invention to provide a new and improved business card filing organization which may be easily and efficiently manufactured and marketed.

It is a further object of the present invention to provide a new and improved business card filing organization which is of a durable and reliable construction.

An even further object of the present invention is to provide a new and improved business card filing organization which is susceptible of a low cost of manufacture with regard to both materials and labor, and which accordingly is then susceptible of low prices of sale to the consuming public, thereby making such business card filing organizations economically available to the buying public.

Still yet another object of the present invention is to provide a new and improved business card filing organization which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
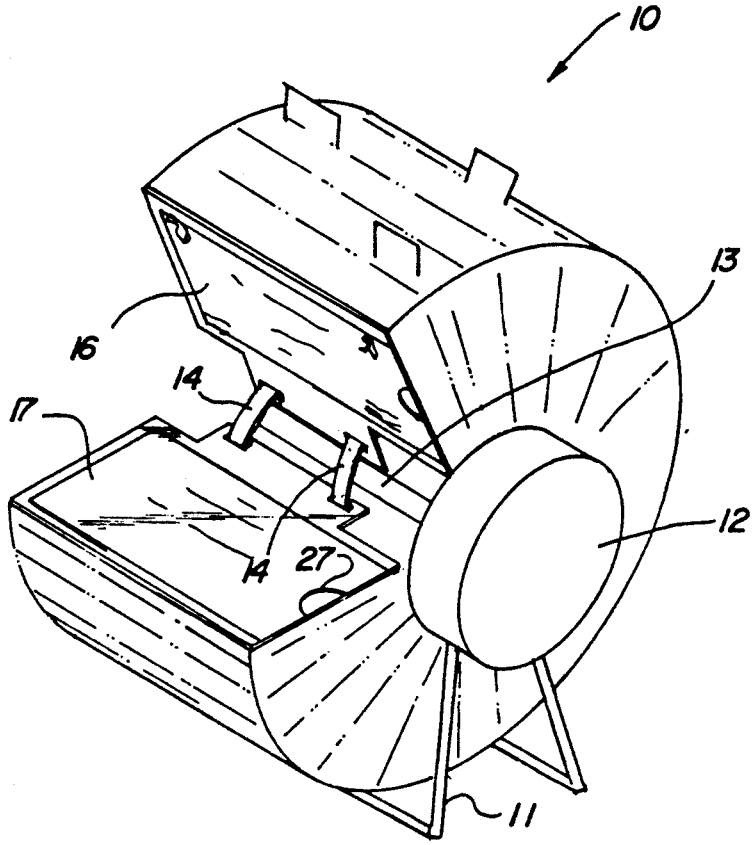
FIG. 1 is an isometric illustration of the instant invention.
Figure 2:
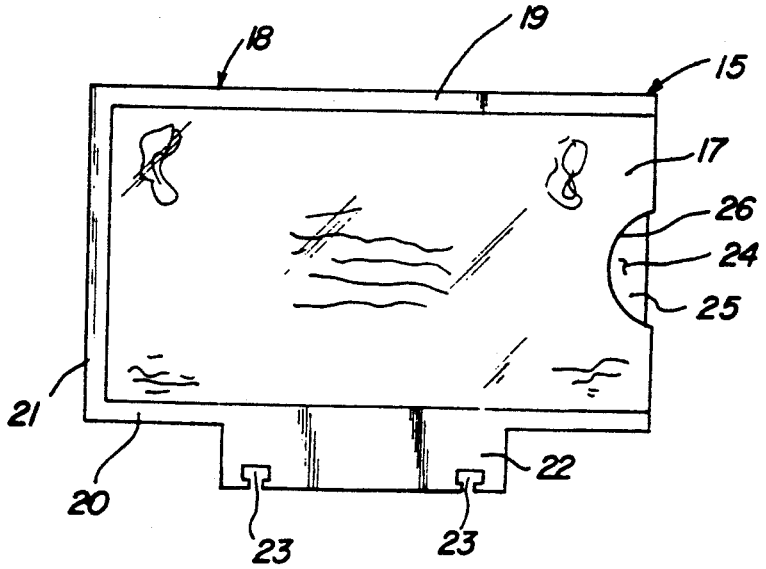
FIG. 2 is an orthographic frontal view, taken in elevation, of a card holder of the invention.

With reference now to the drawings, and in particular to FIGS. 1 to 8 thereof, a new and improved business card filing organization embodying the principles and concepts of the present invention and generally designated by the reference numeral 10 will be described.

More specifically, the business card filing organization 10 of the instant invention essentially comprises a support rack 11 having a rotary dial 12 mounting a rotary axle 13 thereto. The rotary axle 13 includes a plurality of annular support bands 14 concentrically mounted about the support axle in a fixed relationship, with the support bands spaced apart a predetermined spacing. A plurality of card holders 15 are arranged for mounting to the support bands 14 to a support tab 22 mounted to a bottom frame rail 20 of the frame 18. The frame 18, as illustrated in the FIG. 2 for example, includes a U-shaped configuration having top, bottom, and a side rail 19, 20, and 21 respectively. The bottom frame rail 20 includes the support tab 22 having T-shaped slots 23 that are spaced apart the predetermined spacing to receive the support bands 14 therewithin. The card holder 15 includes at least a transparent forward wall 16, and optionally a transparent rear wall 17, that are arranged in a parallel coextensive relationship relative to one another. In this manner, a pocket 24 is defined between the forward and rear walls 16 and 17 and include respective forward and rear thumb recesses 26 and 27 that are coextensively directed into right side edges of the forward and rear walls 16 and 17 to accommodate a business card 25 within a pocket 24 defined between the forward and rear walls 16 and 17.

Figure 3:
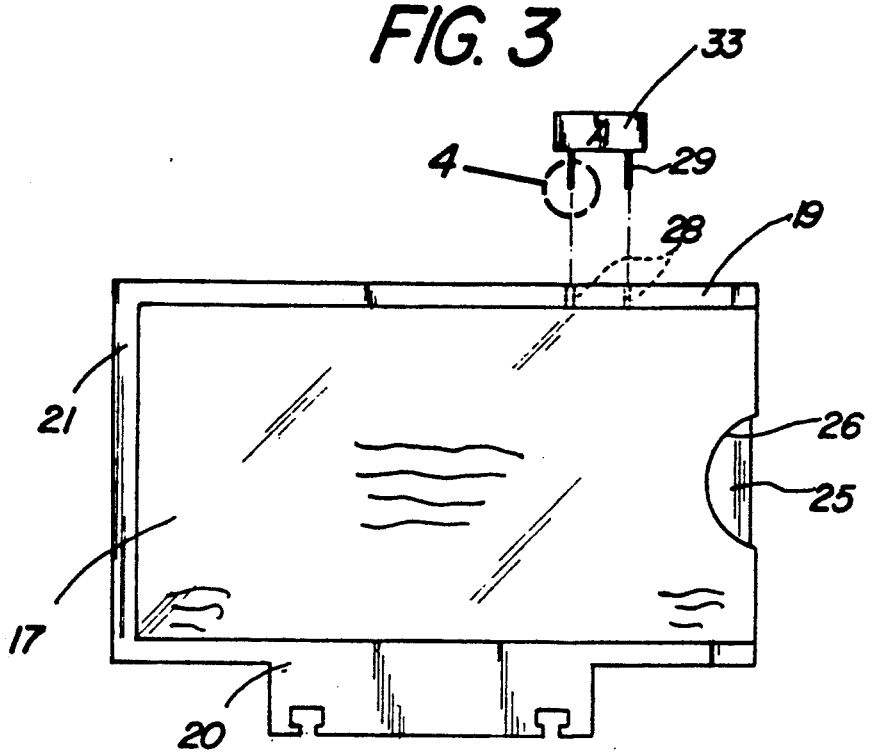
FIG. 3 is an orthographic frontal view of the card holder illustrating the use of an associated tab plate arranged for selective mounting thereto.
Figure 4:
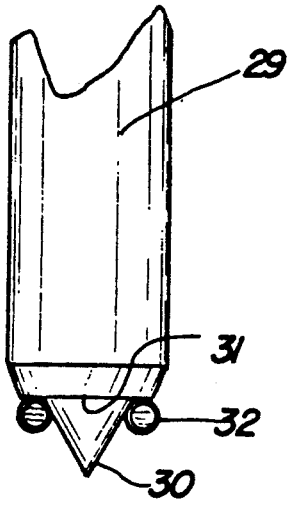
FIG. 4 is an enlarged orthographic view of section 4 as set forth in FIG. 3.

The FIG. 3 illustrates the use of a tab plate 33 having positioning legs 29 fixedly and orthogonally directed downwardly relative to the tab plate 33. Each positioning leg 29 includes a leg lower pointed conical end 30 having a ledge 31 at an inner face between the conical end 30 and the leg 29, with the ledge 31 arranged substantially orthogonally relative to an axis of the leg 29. A glue ring 32 having a frangible shell containing a fluid glue therewithin is mounted on the ledge and is accordingly ruptured upon projection of the legs 29 within the associated receiving bores 28 that are orthogonally directed through the top rail 19. In this manner, a business card 25 is fixedly secured within the associated pocket 24 to prevent displacement or movement thereof relative to the pocket structure.

Figure 5:
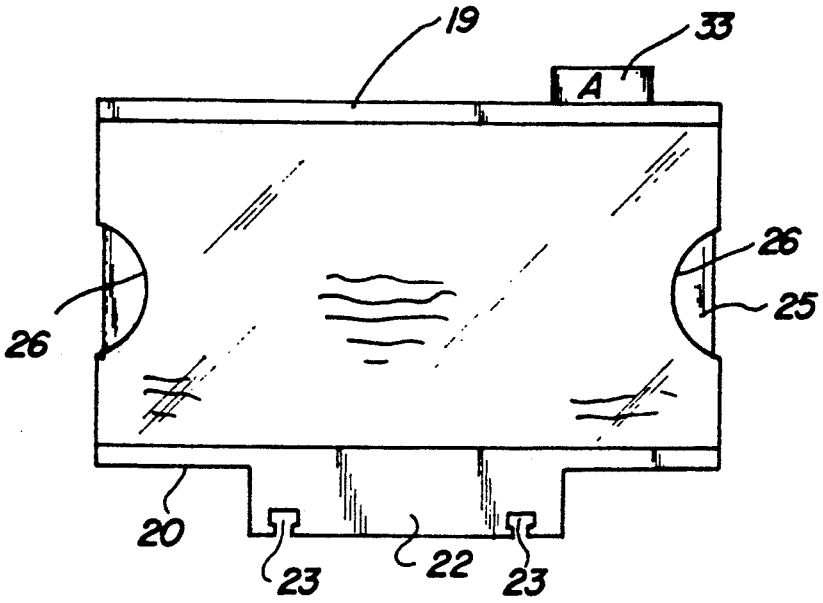
FIG. 5 is an isometric illustration of the card holder structure having entrances at either end thereof.
Figure 6:
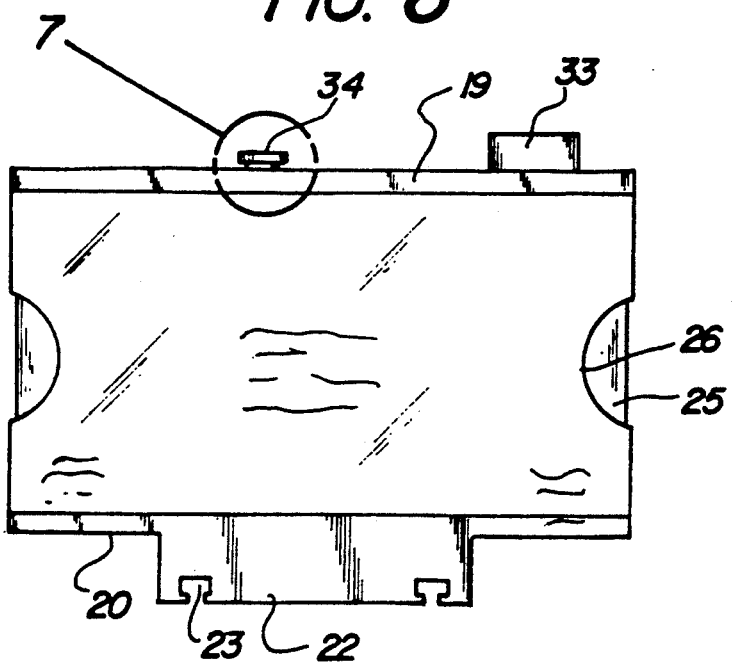
FIG. 6 is an orthographic view of the card holder structure including an indicator plunger member.

The FIGS. 5 and 6 for example illustrate the use of thumb recesses 26 mounted into opposed sides of the card holder 15 for ease of access to the card structure 25 to each side of the pocket structure, as opposed to having entrance to the pocket 24 through only a right side of the card holder 15.

Figure 7:
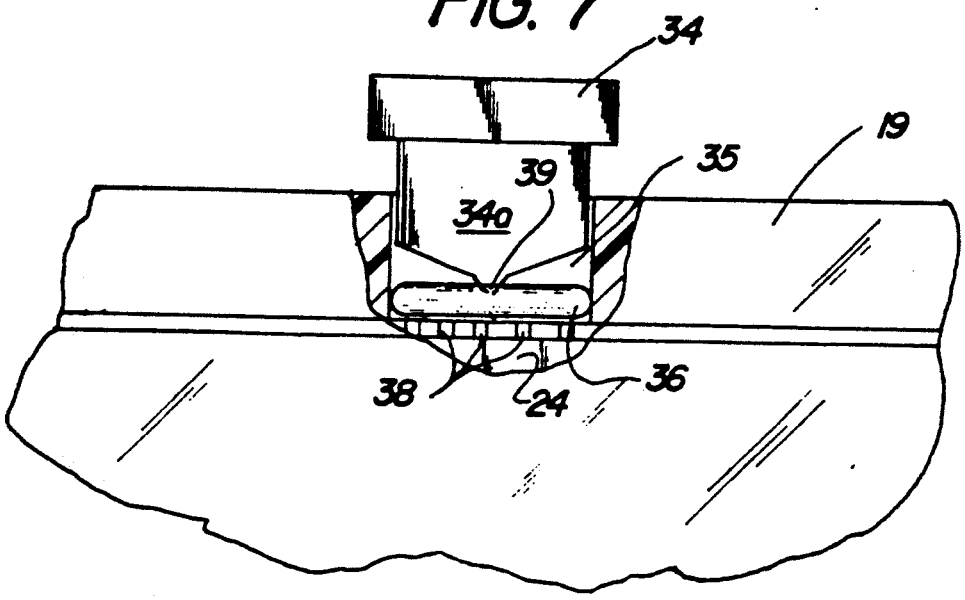
FIG. 7 is an orthographic view, partially in section, of section 7 as set forth in FIG. 6.
Figure 8:
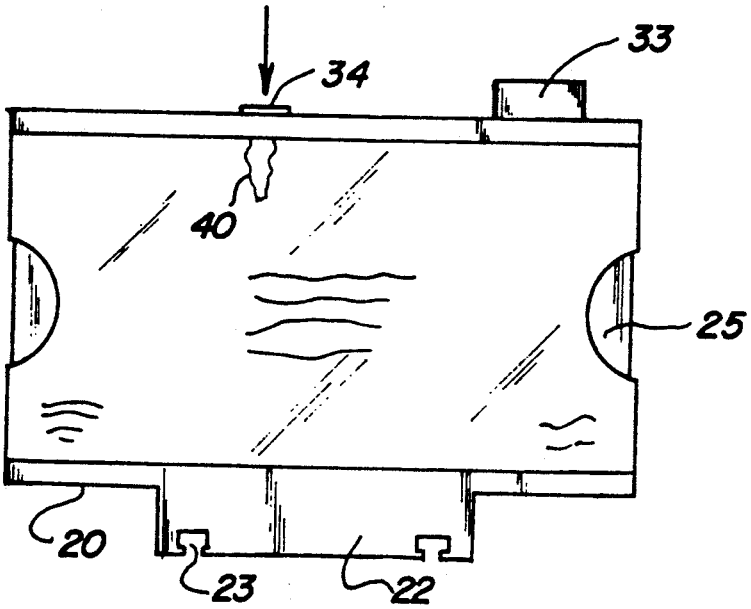
FIG. 8 is an isometric illustration of the card holder structure as set forth in FIG. 6 in use for a marking procedure.

The FIGS. 6–8 illustrate the use of a plunger 34 reciprocatably mounted orthogonally through the top rail 19 having a plunger shank 34*a* received within a top frame rail cavity 35. The plunger shank 34*a* includes a plunger shank piercing tip 39 at a lower distal end of the plunger shank positioned above a dye capsule 36. The dye capsule 36 is mounted to a cavity floor 37 of the cavity 35. The cavity floor 37 includes a plurality of apertures 38 directed therethrough in communication with the pocket 24, whereupon projection of the plunger 34 downwardly into the cavity 35 effects projection of the indicator dye 40 contained within the dye capsule 36 into the cavity to coat an associated business card to note relative importance of the business card. In this manner, various translucent fluid dye 40 may be utilized for such purpose of various coloration for notation of various significance of business cards 25 positioned within each card holder 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A business card filing organization, comprising:

a support rack, the support rack including a plurality of card holders removably mounted thereon, each card holder includes a transparent forward wall parallel to and coextensive with a rear wall, and the forward wall and the rear wall mounted between a top frame rail and a bottom frame rail, and the forward wall and the rear wall each include a respective forward wall first side and a rear wall first side edge, each first side edge including a thumb recess directed therewithin, each thumb recess arranged in a coextensive relationship, and a pocket defined between the forward wall and rear wall and top frame rail and bottom frame rail, and at least one receiving bore orthogonally directed through the top rail in communication with the pocket, and a tab plate, the tab plate including a positioning leg fixedly and orthogonally mounted to a bottom edge of the tab plate, the positioning leg including a lower pointed conical end, and the positioning leg including a leg axis, and a ledge formed at an inner face between the positioning leg and the conical end orthogonally oriented relative to the axis, the ledge including a glue ring mounted thereon.

2. A business card filing organization as set forth in claim 1 wherein the glue ring includes a frangible shell having fluid glue therewithin.

3. A business card filing organization as set forth in claim 2 wherein the top frame rail further includes a shank cavity, the cavity including a cavity floor, the cavity floor having at least one floor aperture directed therethrough in communication with the pocket, and a plunger shank slidably mounted within the cavity, the plunger shank having a plunger head mounted at an upper distal end thereof, and the plunger shank including a plunger shank piercing tip at a lower distal end of the plunger shank, and a dye capsule having an indicator dye contained therewithin positioned on the cavity floor between the piercing tip and the cavity floor.

* * * * *